US012441443B2

(12) United States Patent
Johnston

(10) Patent No.: US 12,441,443 B2
(45) Date of Patent: Oct. 14, 2025

(54) FACE DOWN POOL FLOAT

(71) Applicant: Matthew Johnston, Cave Springs, AR (US)

(72) Inventor: Matthew Johnston, Cave Springs, AR (US)

( * ) Notice: Subject to any disclaimer, the term of this patent is extended or adjusted under 35 U.S.C. 154(b) by 398 days.

(21) Appl. No.: 18/088,398

(22) Filed: Dec. 23, 2022

(65) Prior Publication Data

US 2024/0208616 A1 Jun. 27, 2024

(51) Int. Cl.

| | |
|---|---|
| ***B63C 11/49*** | (2006.01) |
| ***B63B 34/52*** | (2020.01) |
| ***B63B 34/565*** | (2020.01) |

(52) U.S. Cl.

CPC ..... *B63B 34/565* (2020.02); *B63B 34/52* (2020.02); *B63C 11/49* (2013.01)

(58) Field of Classification Search

CPC ..... B63B 34/50; B63B 34/52; B63B 34/54; B63B 34/565; A63B 2225/62; A63B 2225/605; B63C 11/49

See application file for complete search history.

(56) References Cited

U.S. PATENT DOCUMENTS

| | | | | |
|---|---|---|---|---|
| 8,747,175 | B1 * | 6/2014 | Frenna | B63B 34/52 441/129 |
| 10,820,717 | B1 * | 11/2020 | Harkrider | A47C 20/00 |
| 11,148,765 | B2 * | 10/2021 | Pieschel | B63B 34/54 |
| 2015/0232160 | A1 * | 8/2015 | Robinson | B63C 11/205 441/135 |

FOREIGN PATENT DOCUMENTS

| | | | | |
|---|---|---|---|---|
| EP | 2002757 | A1 * | 12/2008 | A47C 1/14 |

* cited by examiner

*Primary Examiner* — Andrew Polay

(74) *Attorney, Agent, or Firm* — Lyman Moulton, Esq.; Moulton Patents, PLLC

(57) ABSTRACT

The face down pool float is the only product of its kind that allows users to float face down while resting on a pool float. This unprecedented product is uniquely designed with a plastic wrap inflatable pillow that can be conveniently replaced and reattached when laying in the face up position, offering flexibility of use, and it is carefully crafted with durable materials to ensure long-term sustainability and functionality.

13 Claims, 3 Drawing Sheets

FACE DOWN POOL FLOAT

BACKGROUND

Relaxing and tanning, in a pool, is an enjoyable pastime via the use of a pool float; yet, current models only support a person laying on their back. In the event a person would like to lay on their stomach, there are no options that allow for face down comfort, specifically for use on water. There have been no products available as original equipment or as an aftermarket to address this problem.

An apparatus that allows users to float on water in multiple positions is not being met by any known device or system at present. There have been no products available as original equipment or as an aftermarket to address this problem either.

SUMMARY OF THE INVENTION

The main purpose of the face down pool float is to provide users with a method of laying on their stomachs, comfortably, while on a pool float.

Figure 1:
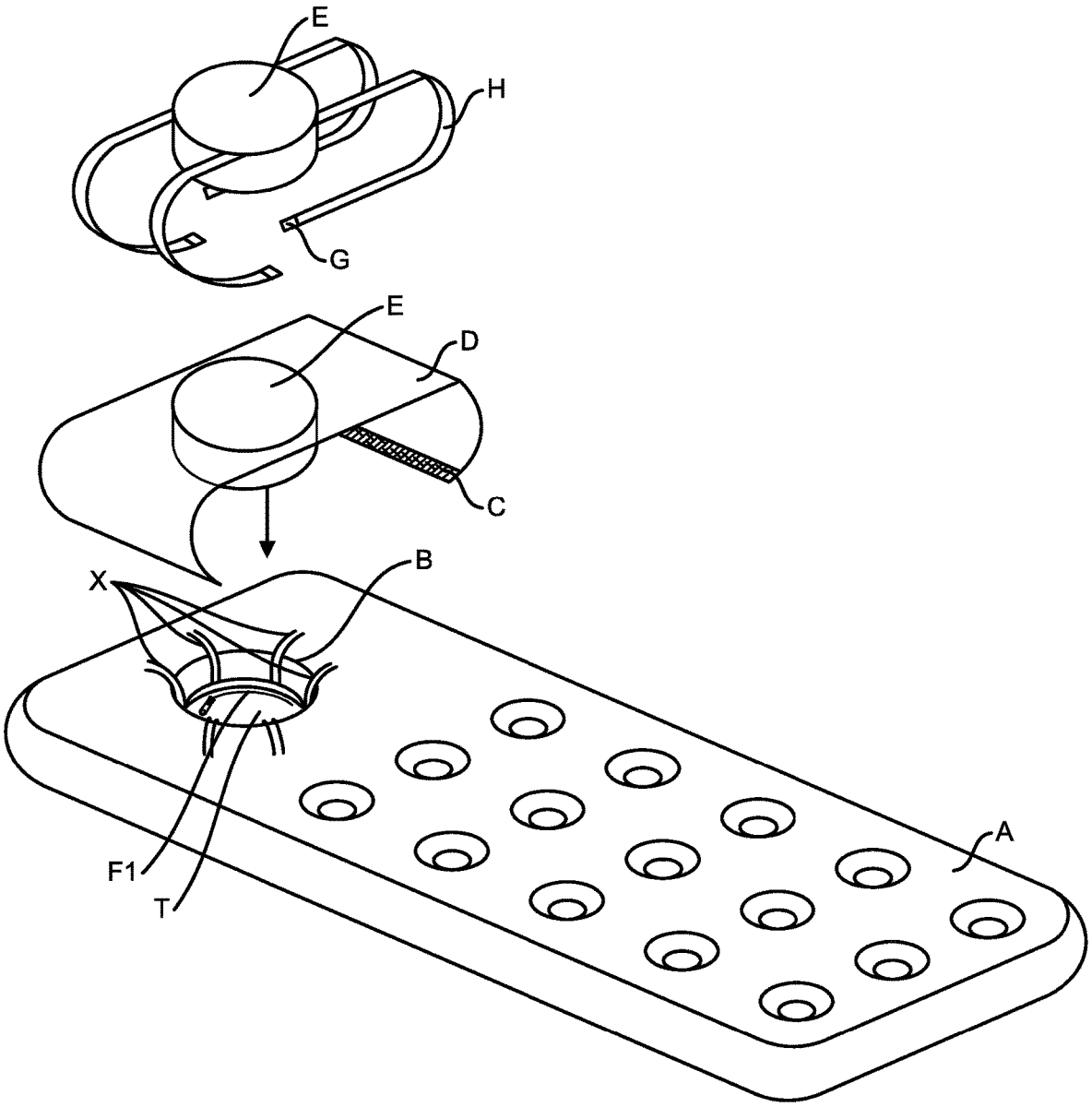
FIG. 1 is a top perspective view of the face down pool float with face opening bottom pouch and pillow accessories in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a top perspective view of the face down pool float with face opening to bottom pouch and pillow accessories showing: pool float referenced as A, opening for face deep enough to breath referenced as B, Velcro referenced as C, plastic wrap referenced as D, inflatable pillow to fill face opening referenced as E, optional zippered pouch referenced as F1 with a transparent top layer T through which users can view a cell phone, wallet, etc, buckle referenced as G, straps (different option to attach) referenced as H, in accordance with an embodiment of the present disclosure. The airhole channels X or formed creases enable an air flow for a users to breathe there through when their face is filling the opening B. The airhole channels or creases are also implemented as multiple straws with open ends to a bottom and a top of the opening B with respect to a bottom and top of the pool float where the top is where the user lays and the bottom floats on a pool surface.

Figure 2:
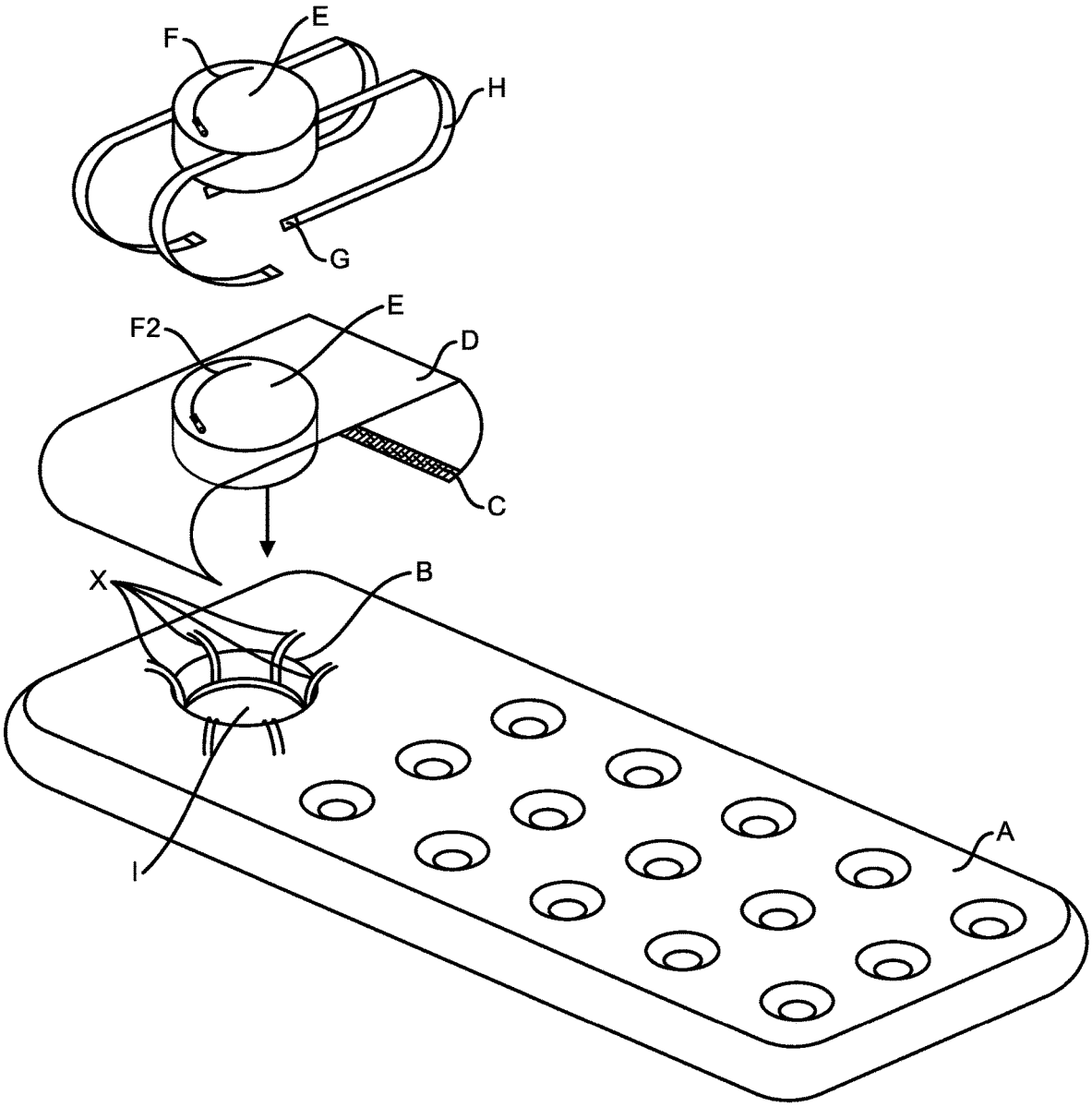
FIG. 2 is a top perspective view of the face down pool float with face opening to water with pillow accessories in accordance with an embodiment of the present disclosure.

FIG. 2 is a top perspective view of the face down pool float with face opening to water and pillow accessories showing: pool float referenced as A, opening for face deep enough to breath referenced as B, Velcro referenced as C, plastic wrap referenced as D, inflatable pillow to fill face opening referenced as E, optional zippered pouch referenced as F2, buckle referenced as G, straps (different option to attach) referenced as H, open to the water referenced as I, in accordance with an embodiment of the present disclosure. The airhole channels X or formed creases enable an air flow for a users to breathe there through when their face is filling the opening B. The airhole channels or creases are also implemented as multiple straws with open ends to a bottom and a top of the opening B with respect to a bottom and top of the pool float where the top is where the user lays and the bottom floats on a pool surface.

Figure 3:
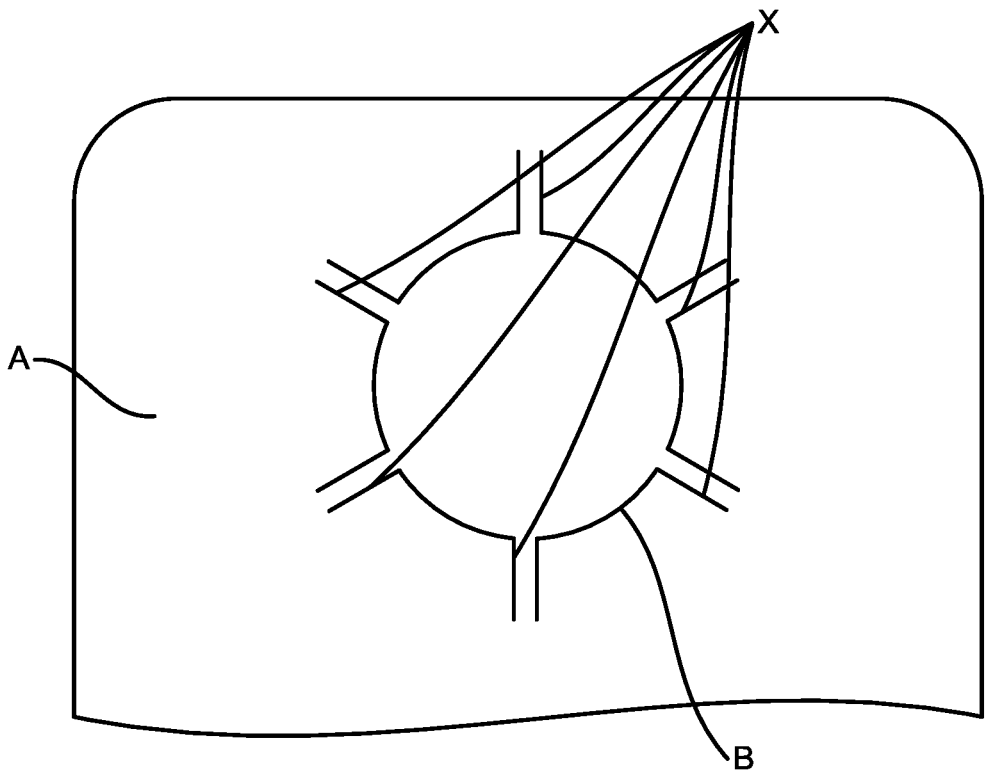
FIG. 3 is a top elevational view of the face down pool float and the air channel creases for breathing air there through in accordance with an embodiment of the present disclosure.

FIG. 3 is a top elevational view of the face down pool float and the air channel creases for breathing air there through in accordance with an embodiment of the present disclosure. The airhole channels X or formed creases enable an air flow for a users to breathe there through when their face is filling the opening B. The airhole channels or creases are also implemented as multiple straws with open ends to a bottom and a top of the opening B with respect to a bottom and top of the pool float where the top is where the user lays and the bottom floats on a pool surface.

Ingenious and practical, the face down pool float offers a modern accessory that provides users with the ability to lay face down on a pool float, at maximum comfort, supporting a perfect position for tanning one's back and overall relaxation. The face down pool float would function like other pool floats, but introduces a novel face opening to give the user the ability to comfortably float face down. To expose the opening, one would simply remove the detachable head cushion which reveals an open hole with depth. To ensure users are able to breathe easily while their face is down on the float, the hole possesses side openings near the face to ensure air circulation, as it's a comfortable distance above the water. Furthermore, when the facial opening is not in use, a person can utilize the hole area as a waterproof storage compartment as the float includes an option to seal the bottom, when desired. With the face down pool float, individuals will be able to lie on water and sunbathe face down with great ease.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A pool float system, comprising:

a pool float having a thickness for a prone person thereon and an opening defined to receive the person's face and a breathing space there between; and a pillow accessory to the pool float configured to be received into the opening and to attach thereto, wherein the pillow accessory comprises a zippered pouch.

2. The pool float system of claim 1, wherein the pillow accessory is received into the opening and attached thereto via a plurality of straps configured to fasten around the pool float.

3. The pool float system of claim 1, wherein the pillow accessory is received into the opening and attached to the pool float via a wrap configured to attach to the pool float itself via hook and loop.

4. The pool float system of claim 1, wherein the pillow accessory is received into the opening and attached thereto via a hook and loop on the pillow accessory and on an inside wall of the opening.

5. The pool float system of claim 1, wherein the opening comprises air flow channel creases in a sidewall thereof.

6. The pool float system of claim 1, wherein the opening extends all the way through the thickness of the pool float.

7. The pool float system of claim 1, further comprising a membrane across a bottom side portion of the pool float and across a bottom of the opening.

8. The pool float system of claim 1, wherein the opening stops short of extending all the way through the thickness of the pool float.

9. The pool float system of claim 1, wherein a thickness of the pillow accessory is equal to the thickness of the pool float.

10. The pool float system of claim 1, wherein a thickness of the pillow accessory is equal to the pool float thickness and flush there with.

11. The pool float system of claim 1, further comprising a zipper pouch configured to cover the opening adjacent a bottom side of the pool float.

12. The pool float system of claim 11, wherein a top side of the zipper pouch comprises a transparent window for a visibility to the prone person.

13. The pool float system of claim 1, further comprising a wrap configured to encircle an end of the pool float and define an opening therein adjacent the pool float opening.

* * * * *